US005636754A

United States Patent [19]

Ennis

[11] Patent Number: 5,636,754

[45] Date of Patent: Jun. 10, 1997

[54] GOLF CLUB STAND APPARATUS

[76] Inventor: Lynwood P. Ennis, P.O. Box 231, LaFayette, Ala. 36862

[21] Appl. No.: 514,487

[22] Filed: Aug. 11, 1995

[51] Int. Cl.[6] ..... A63B 55/00

[52] U.S. Cl. ..... 211/70.2; 248/156; 473/282

[58] Field of Search ..... 248/156, 354.3, 248/188.4; 211/70.2; 206/315.2; 473/282

[56] References Cited

U.S. PATENT DOCUMENTS

| | | | |
|---|---|---|---|
| D. 304,788 | 11/1989 | McJunkin . | |
| D. 351,444 | 10/1994 | Hunter . | |
| 1,443,230 | 1/1923 | Luckett | 248/156 |
| 2,270,325 | 1/1942 | Matthews | 248/156 X |
| 3,027,140 | 3/1962 | Holzbach | 248/354.3 |
| 3,483,996 | 12/1969 | Scammon . | |
| 3,858,833 | 1/1975 | Fink . | |
| 4,036,371 | 7/1977 | Michel | 248/188.4 X |
| 4,524,533 | 6/1985 | Still, Jr. | 248/156 X |
| 4,789,121 | 12/1988 | Gidseg et al. | 248/188.4 |
| 4,938,446 | 7/1990 | Williams . | |
| 5,065,975 | 11/1991 | Giles | 248/156 X |
| 5,127,530 | 7/1992 | Ortuno . | |
| 5,149,087 | 9/1992 | Thompson, Jr. | 248/156 X |
| 5,271,196 | 12/1993 | Fanti | 248/156 X |
| 5,390,916 | 2/1995 | Govoni | 248/156 X |

*Primary Examiner*—Korie Chan

[57] ABSTRACT

A golf club stand apparatus includes a base assembly including a central portion and a peripheral portion which surrounds the central portion. A pair of decreasing-width stake members project downwardly from the peripheral portion of the base assembly. A riser assembly is connected to the central portion of the base assembly and projects upwardly from the base assembly. A resting arm assembly is connected to a top portion of the riser assembly. Each of the decreasing-width stake members includes a relatively wide base portion and a tapering body portion which ends in a sharp point. The riser assembly includes a tubing assembly which includes a first adaptor connected to the central portion of the base assembly. A straight tube member is connected to the first adaptor, and a second adaptor is connected to the straight tube member. The base assembly includes an externally threaded riser-connector portion. The first adaptor includes an internally threaded portion and an externally threaded portion. The second adaptor includes an internally threaded portion and an externally threaded portion. The resting arm assembly includes a hub assembly which is connected to the riser assembly. A pair of arcuate-shaped arm members project in opposite directions outwardly from the hub assembly. The hub assembly includes a central channel. A shaft portion of an arm-assembly connector passes through the central channel of the hub assembly for connecting the resting arm assembly to the riser assembly.

4 Claims, 2 Drawing Sheets

GOLF CLUB STAND APPARATUS

BACKGROUND OF THE INVENTION

1. Field of the Invention

The present invention relates generally to devices for holding golf dubs when not in use and, more particularly, to devices for holding golf clubs especially adapted for use on a golf course.

2. Description of the Prior Art

When persons play golf, there are often occasions when the golfer wants to have two hands free for some action or activity. As a result, the golfer often lays a golf club down on the turf. However, if the turf is wet, the golf club that is lain down on the turf will itself become wet. To avoid wetting a golf club in this manner, it would be desirable if a golfer can have two hands free without laying a golf club down on the turf.

Throughout the years, a number of innovations have been developed relating to golf stands which permit a golfer to have two hands free without laying a golf club on the turf, and the following U.S. patents are representative of some of those innovations: U.S. Pat. Nos. 3,483,996; 5,127,530; and U.S. Pat. No. Des. 351,444. More specifically, U.S. Pat. No. 3,483,996 discloses a golf club stand which includes two stake members spaced relatively far apart from one another and a transverse strut connecting the two stake members together, wherein the two stake members and the transverse strut lie in substantially the same plane. Moreover, the length of the transverse strut is substantially longer than the depth at which the ends of the two stake members are driven into the ground. As a result, if a force is exerted on either stake member in a direction perpendicular to the plane in which the two stake members lie, and especially if the perpendicular force is exerted near the top of a stake member whereby greater leverage is developed with respect to the portion of the stake members driven into the ground, then the golf club stand in this patent offers relatively little resistance against the stand being knocked over. In this respect, it would be desirable if a golf club stand device were provided which offers increased resistance to being knocked over by a force exerted near the top of a stake member.

U.S. Pat. No. 5,127,530 discloses a golf club stand which has a straight stake portion and an off-center, U-shaped club-receiving portion at the top. The straight nature of the stake portion gives very little control as to the depth into the ground that the stake can penetrate. The off-center nature of the club-receiving portion causes a torque to be developed around the straight stake portion when a club is received by the club-receiving portion. In this respect, it would be desirable if a golf club stand employs a device for controlling the depth of penetration of the stake portion into the ground. To reduce the presence of torque forces when a club is received by the club-receiving portion, it would be desirable if the club-receiving portion were symmetrically disposed around the stake member.

U.S. Pat. No. Des. 351,444 discloses a golf club support which includes a ground-penetrating stake portion and a long, hollow, cylindrical body portion that has an open top. The hollow, cylindrical body portion can act as a cup or retainer for rain and dirt, and this container aspect of this patent is undesirable. In this respect, it would be desirable if a golf club stand does not include an open-top, hollow, cylindrical body portion that can serve as a retainer of water and dirt.

In addition, the following U.S. patents disclose some additional innovations relating to object holders that include stake portions driven into the ground: U.S. Pat. Nos. 3,858,833 and 4,938,446. More specifically, U.S. Pat. No. 3,858,833 discloses fishing rod holder that includes a single stake portion that is driven into the ground. A riser portion composed of a plurality of telescopically connected elements extends upward from the stake portion. The single stake portion provides a minimal amount of resistance to twisting caused by torque forces operating around the single stake portion. In this respect, it would be desirable if a golf club stand employed a plurality of separate stake portions to provide resistance against twisting due to torque forces.

U.S. Pat. No. 4,938,446 discloses a fishing rod support that includes two separated stake portions that are driven into the ground. For each stake portion, the ground-penetrating portion is composed of a straight rod. Moreover, the two stake portions are separated from each other by such a distance that compaction of the soil between the two stake portions is inconsequential. Because compaction of soil between two stake portions would help stabilize a golf club stand with respect to both twisting in response to torque forces and being knocked over in response to forces exerted perpendicular to the golf club stand, it would be desirable if a golf club stand included a stake arrangement which provides for compaction of soil between adjacent stake members.

Still other features would be desirable in a golf club stand apparatus. For ease of storage, it would be desirable if a golf club stand apparatus were composed of components that can easily be assembled and disassembled. Thus, while the foregoing body of prior art indicates it to be well known to use golf club stands, the prior art described above does not teach or suggest a golf club stand apparatus which has the following combination of desirable features: (1) permits a golfer to have two hands free without laying a golf club down on the turf; (2) offers increased resistance to being knocked over by a force exerted near the top of a stake member; (3) employs a device for controlling the depth of penetration of the stake portion into the ground; (4) has a club-receiving portion which is symmetrically disposed around the stake member; (5) does not include an open-top, hollow, cylindrical body portion that can serve as a retainer for water and dirt; (6) employs a plurality of separate stake portions to provide resistance against twisting due to torque forces; (7)includes a stake arrangement which provides for compaction of soil between adjacent stake members; and (8) is composed of components that can easily be assembled and disassembled.

The foregoing desired characteristics are provided by the unique golf club stand apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a golf club stand apparatus. More generally, the present invention provides a ground-driven-stake stand apparatus which may be employed for supporting a variety of articles such as golf clubs, baseball bats, fishing rods, rifles, and other elongate objects. In this respect, the ground-driven-stake stand apparatus includes a base assembly which includes a central portion and a peripheral portion which surrounds the central portion. A pair of decreasing-width stake members are supported by the base assembly and project downwardly from the peripheral portion of the base assembly. A riser assembly is connected to the central portion of the base assembly. The riser assembly projects upwardly from the base assembly, and a resting arm assembly is connected to a top portion of the riser assembly. Each of the decreasing-width stake members includes a relatively wide base portion and a tapering body portion which ends in a sharp point.

The riser assembly includes a tubing assembly which includes a first adaptor connected to the central portion of the base assembly. A straight tube member is connected to the first adaptor, and a second adaptor is connected to the straight tube member. The base assembly includes an externally threaded riser-connector portion. The first adaptor includes an internally threaded portion and an externally threaded portion. The second adaptor includes an internally threaded portion and an externally threaded portion.

The resting arm assembly includes a hub assembly which is connected to the riser assembly. A pair of arm members project in opposite directions outward from the hub assembly. The pair of arm members are arcuate shaped. The hub assembly includes a central channel. A shaft portion of an arm-assembly connector passes through the central channel of the hub assembly for connecting the resting arm assembly to the riser assembly. The arm-assembly connector includes an externally threaded portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club stand apparatus which has all of the advantages of the prior art and none of the disadvantages.

It is another object of the present invention to provide a new and improved golf club stand apparatus which may be easily and efficiently manufactured and marketed.

It is a further object of the present invention to provide a new and improved golf club stand apparatus which is of durable and reliable construction.

An even further object of the present invention is to provide a new and improved golf club stand apparatus which is susceptible of a low cost of manufacture with regard to both materials and labor, and which accordingly is then susceptible of low prices of sale to the consuming public, thereby making such golf club stand apparatus available to the buying public.

Still yet a further object of the present invention is to provide a new and improved golf club stand apparatus which permits a golfer to have two hands free without laying a golf club down on the turf.

Still another object of the present invention is to provide a new and improved golf club stand apparatus that offers increased resistance to being knocked over by a force exerted near the top of a stake member.

Yet another object of the present invention is to provide a new and improved golf club stand apparatus which employs a device for controlling the depth of penetration of the stake portion into the ground.

Even another object of the present invention is to provide a new and improved golf club stand apparatus that has a club-receiving portion which is symmetrically disposed around the stake member.

Still a further object of the present invention is to provide a new and improved golf club stand apparatus which does not include an open-top, hollow, cylindrical body portion that can serve as a retainer for water and dirt.

Yet another object of the present invention is to provide a new and improved golf club stand apparatus that employs a plurality of separate stake portions to provide resistance against twisting due to torque forces.

Still another object of the present invention is to provide a new and improved golf club stand apparatus which includes a stake arrangement which provides for compaction of soil between adjacent stake members.

Yet another object of the present invention is to provide a new and improved golf club stand apparatus that is composed of components that can easily be assembled and disassembled.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved golf club stand apparatus embodying the principles and concepts of the present invention will be described.

Figure 1:
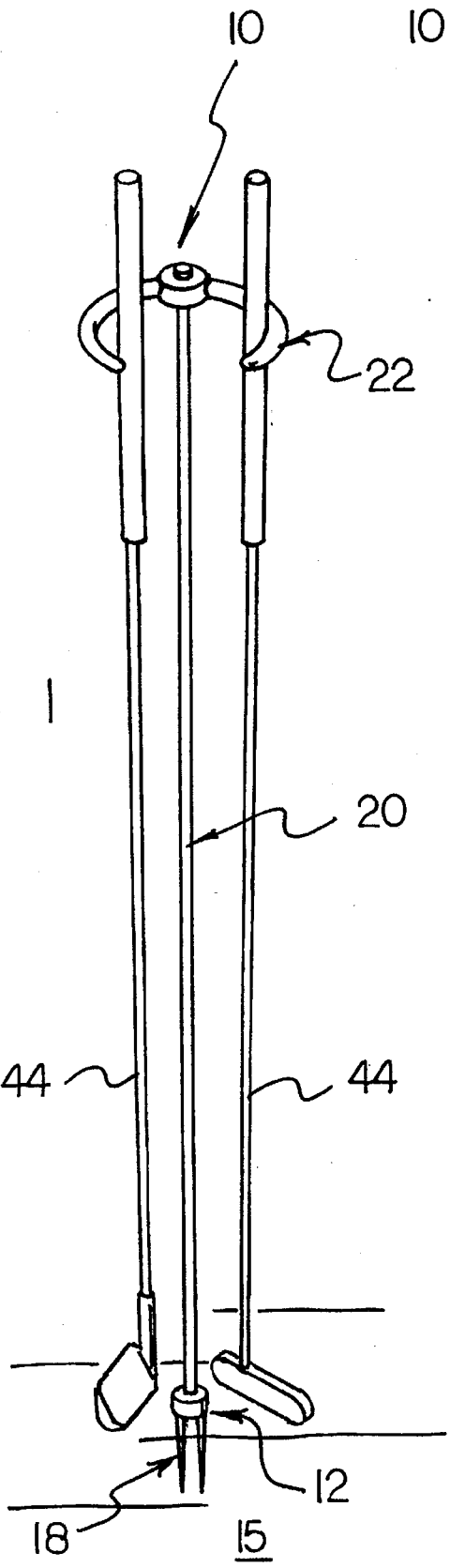
FIG. 1 is a perspective view showing a preferred embodiment of the golf club stand apparatus of the invention in use supporting two golf clubs.
Figure 2:
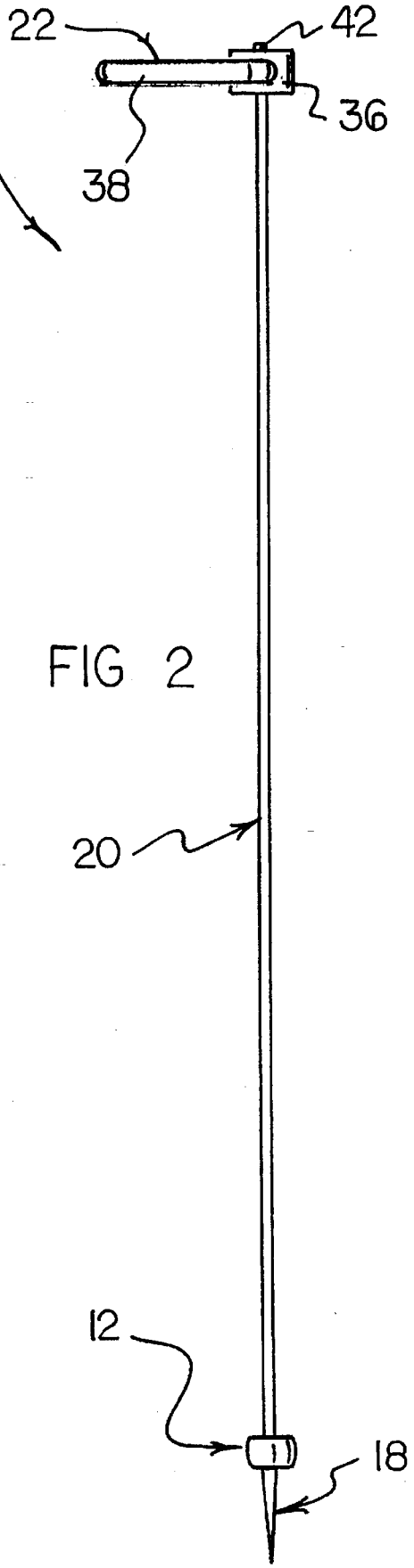
FIG. 2 is an enlarged side view of the embodiment of the invention shown in FIG. 1 removed from the ground.
Figure 3:
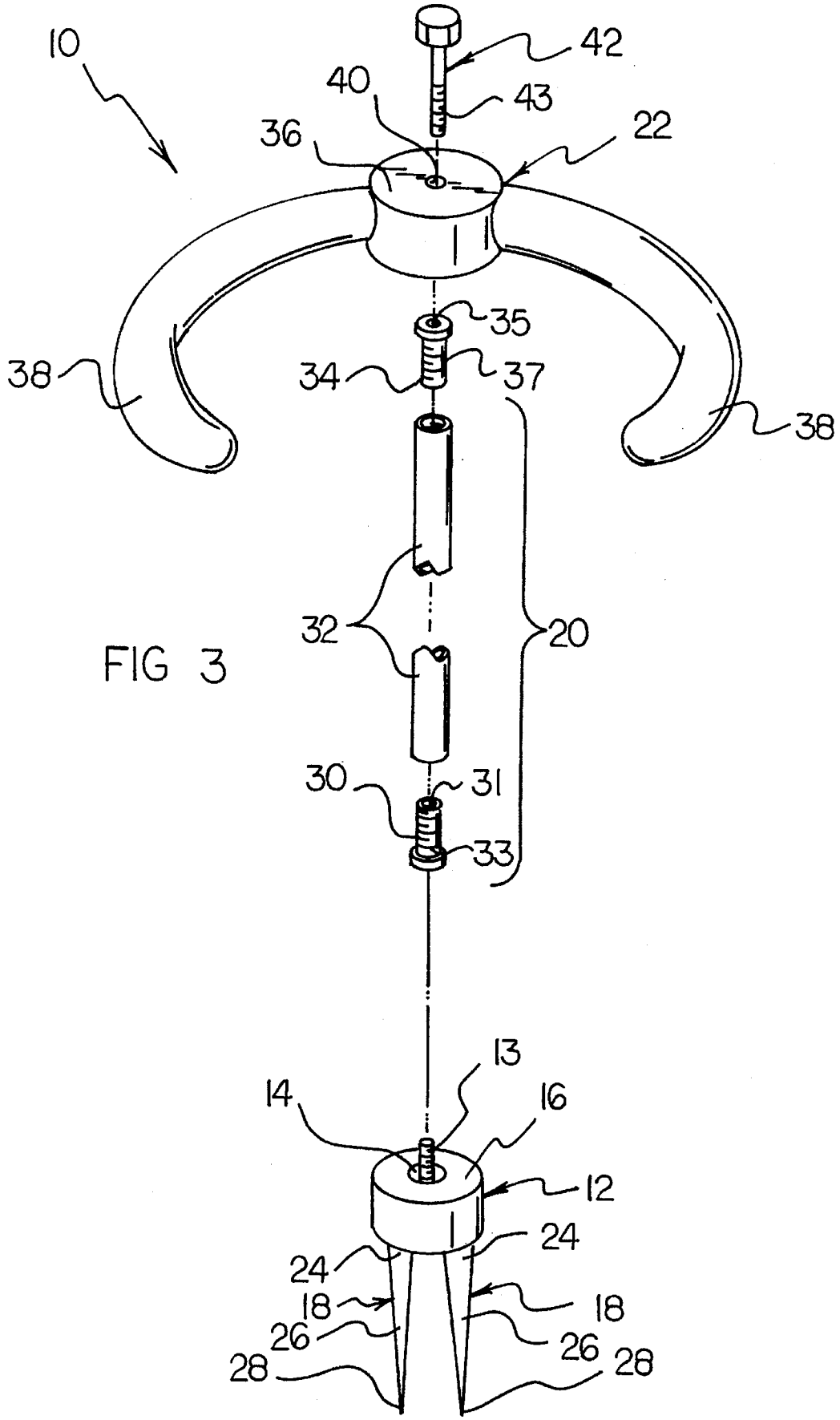
FIG. 3 is an exploded view, partially enlarged, of the embodiment of the invention shown in FIGS. 1 and 2.

Turning to FIGS. 1–3, there is shown an exemplary embodiment of the golf club stand apparatus of the invention generally designated by reference numeral 10. In its preferred form, golf club stand apparatus 10 includes a base assembly 12 which includes a central portion 14 and a peripheral portion 16 which surrounds the central portion 14. A pair of decreasing-width stake members 18 are supported by the base assembly 12 and project downwardly from the peripheral portion 16 of the base assembly 12. A riser assembly 20 is connected to the central portion 14 of the base assembly 12. The riser assembly 20 projects upwardly from the base assembly 12 to terminate in an uppermost end, and a resting arm assembly 22 is connected to a top portion of the riser assembly 20. Each of the decreasing-width stake members 18 includes a relatively wide base portion 24 and a tapering body portion 26 which ends in a sharp point 28.

The riser assembly 20 includes a tubing assembly 20 which includes a first adaptor 30 connected to the central portion 14 of the base assembly 12. A straight tube member 32 is connected to the first adaptor 30, and a second adaptor 34 is connected to the straight tube member 32. The base assembly 12 includes an externally threaded riser-connector portion 13. The first adaptor 30 includes an internally threaded portion 31 and an externally threaded portion 33. The second adaptor 34 includes an internally threaded portion 35 and an externally threaded portion 37.

The resting arm assembly 22 includes a hub assembly 36 which is connected to the riser assembly 20. A pair of arm members 38 project in opposite directions outward from the hub assembly 36. The arm members 38 extend substantially orthogonally away from the riser assembly 20 and terminate at free ends spaced an equal distance away from the riser assembly. Further, the arcuate arm members 38 are positioned so as to reside within a plane oriented substantially orthogonally relative to a plane containing the riser assembly 20. By this structure, the free ends of the arm members 38 can be grasped be a user to force the base assembly 12 into a ground surface. The pair of arm members 38 are arcuate shaped. As shown in FIGS. 1 and 3, the arm members 38 curve towards each other to define an interior space located between the arms within which a handle of a golf club can be positioned for support. The interior space has an interior space maximum width accommodating one or more golf club handles. The free ends of the arm members are spaced apart a distance substantially less than the interior space maximum width. By this structure, golf club handles positioned within the interior space are retained within the confines of the arm members to be precluded from unintentional disengagement from the invention 10. The hub assembly 36 includes a central channel 40. A shaft portion of an arm-assembly connector 42 passes through the central channel 40 of the hub assembly 36 for connecting the resting arm assembly 22 to the riser assembly 20. The arm-assembly connector 42 includes an externally threaded portion 43.

The golf club stand apparatus 10 of the invention can be assembled from its component parts as follows. The first adaptor 30 is screwed onto the threaded stud 13 on the base assembly 12. The straight tube member 32 is screwed onto the first adaptor 30. The second adaptor 34 is screwed onto the straight tube member 32. The hub assembly 36 of the resting arm assembly 22 is placed over the second adaptor 34 so that the central channel 40 of the hub assembly 36 is placed in registration with the internally threaded portion 35 of the second adaptor 34. Then, the shaft of the arm-assembly connector 42 is passed through the central channel 40, and the externally threaded portion 43 of the arm-assembly connector 42 is screwed into the internally threaded portion 35 of the second adaptor 34. To assist in maintaining the parts securely assembled during use, conventional lock washers (not shown) may advantageously be used on the shank of connector 42 and on stud 13 as will obviously occur to those of ordinary skill in the art. To disassemble the golf dub stand apparatus 10 of the invention, the reverse procedure is employed.

To use the assembly golf club stand apparatus 10, the arm members 38 can be grasped by a golfer. A portion of the ground 15 is selected, and the decreasing-width stake members 18 are driven into the ground 15. Because each of the decreasing-width stake members 18 includes a relatively wide base portion 24 and a tapering body portion 26 which ends in a sharp point 28, as the decreasing-width stake members 18 penetrate the ground 15, a portion of the ground 15 between the decreasing-width stake members 18 is compacted between the members 18. More specifically, the portion of the ground 15 between the members 18 is wedged in and squeezed between the tapering members 18 as the members 18 are driven into the ground 15. Moreover, the base assembly 12 serves as a stop member to prevent the decreasing-width stake members 18 from penetrating into the ground 15 beyond the length of the members 18.

Since the decreasing-width stake members 18 are disposed in the peripheral portion 16 of the base assembly 12 around the central portion 14, the stake members 18 serve to prevent twisting of the base assembly 12 in the event that torque forces are applied to the resting arm assembly 22. Once the stake members 18 are in the ground 15, one or more golf clubs 44 can be leaned up against the resting arm assembly 22. As shown in FIG. 1, the handles of the golf clubs 44 are leaning up against the arm members 38 of the resting arm assembly 22, whereby the golf clubs 44 are permitted to stand on the ground 15. As shown in FIG. 1, two golf clubs 44 standing on the ground 15 and are supported simultaneously by the symmetrically disposed arm members 38. In this way, torque forces around the riser assembly 20 are minimized.

Once the golf club stand apparatus 10 is temporarily no longer needed, the arm members 38 can be grasped and rocked back and forth along with an upward pulling-up action. In this way, the stake members 18 are pulled out of the ground 15. Then, the golf club stand apparatus 10 can be carried to another location for further use.

The components of the golf dub stand apparatus of the invention can be made from inexpensive and durable metal and plastic materials. Preferably, metals that are employed will not rust. Aluminum is a lightweight and strong metal that will not rust, and the riser assembly preferably includes a straight aluminum tube member.

As stated above, generally speaking, the present invention provides a ground-driven-stake stand apparatus which may be employed for supporting a variety of articles such as golf clubs, baseball bats, fishing rods, rifles, and other elongate objects whose weight is mostly supported by the ground but that leans on an above-ground object.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golf club stand apparatus that is low in cost, relatively simple in design and operation, and which may advantageously be used to permit a golfer to have two hands free without laying a golf club down on the turf. With the invention, a golf club stand apparatus is provided which offers increased resistance to being knocked over by a force exerted near the top of a stake member. With the invention, a golf club stand apparatus is provided which employs a device for controlling the depth of penetration of the stake portion into the ground. With the invention, a golf club stand apparatus is provided which has a club-receiving portion which is symmetrically disposed around the stake member. With the invention, a golf club stand apparatus is provided which does not include an open-top, hollow, cylindrical body portion that can serve as a retainer for water and dirt. With the invention, a golf club stand apparatus is provided which employs a plurality of separate stake portions to provide resistance against twisting due to torque forces. With the invention, a golf club stand apparatus is provided which includes a stake arrangement which provides for compaction of soil between adjacent stake members. With the invention, a golf club stand apparatus is provided which is composed of components that can easily be assembled and disassembled.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and descried in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A ground-driven-stake stand apparatus, comprising:

a base assembly which includes a central portion and a peripheral portion which surrounds said central portion, a pair of decreasing-width stake members, wherein each of said decreasing-width stake members is supported by said base assembly and projects downwardly from said peripheral portion of said base assembly, a riser assembly connected to said central portion of said base assembly, wherein said riser assembly projects upwardly from said base assembly, said riser assembly terminating in an uppermost end, and a resting arm assembly connected to said uppermost end of said riser assembly;

wherein said resting arm assembly includes a hub assembly connected to said riser assembly, and a pair of arm members projecting in opposite directions from said hub assembly, said arm members extending substantially orthogonally away from said riser assembly and terminating at free ends spaced an equal distance away from said riser assembly, said arm members residing within a plane oriented substantially orthogonally relative to a plane containing said riser assembly, whereby said free ends of said arm members can be grasped be a user to force the base assembly into a ground surface;

wherein said arm members are substantially arcuate in shape and curve towards each other to define an interior space between the arms within which a handle of a golf club can be positioned, the interior space having an interior space maximum width, with the free ends of the arm members being spaced apart a distance substantially less than the interior space maximum width.

2. The apparatus of claim 1 wherein each of said decreasing-width stake members includes a relatively wide base portion and a tapering body portion which ends in a sharp point.

3. The apparatus of claim 1 wherein said riser assembly includes a tubing assembly which includes:

a first adaptor connected to said central portion of said base assembly, a straight tube member connected to said first adaptor, and a second adaptor connected to said straight tube member.

4. The apparatus of claim 3 wherein:

said base assembly includes an externally threaded riser-connector portion, said first adaptor includes an internally threaded portion and an externally threaded portion, and second adaptor includes an internally threaded portion and an externally threaded portion.

* * * * *